US006571968B1

(12) United States Patent
Cullen

(10) Patent No.: US 6,571,968 B1
(45) Date of Patent: Jun. 3, 2003

(54) RACK AND HOOKS FOR HANGING WORKPIECES IN INDUSTRIAL COATING SYSTEMS

(75) Inventor: Lawrence E. Cullen, Hayden Lake, ID (US)

(73) Assignee: Mighty Hook, Inc., Chicago, IL (US)

( * ) Notice: Subject to any disclaimer, the term of this patent is extended or adjusted under 35 U.S.C. 154(b) by 0 days.

(21) Appl. No.: 09/592,134

(22) Filed: Jun. 12, 2000

Related U.S. Application Data

(63) Continuation-in-part of application No. 09/455,150, filed on Dec. 6, 1999, now Pat. No. 6,189,709.

(51) Int. Cl.[7] ..... A47F 5/00

(52) U.S. Cl. ..... 211/113; 211/118; 211/119; 204/297.01; 204/297.09; 118/500

(58) Field of Search ..... 211/113, 118, 211/119; 204/297.01, 297.06, 297.09; 118/500

(56) References Cited

U.S. PATENT DOCUMENTS 1,533,805 A 4/1925 Oliver
4,243,146 A * 1/1981 Dawitz ..... 211/118
4,679,526 A * 7/1987 Dziedic ..... 118/503
4,872,963 A * 10/1989 Van Horn ..... 118/500
5,088,609 A * 2/1992 Fryc ..... 211/117
5,147,050 A 9/1992 Cullen
5,524,774 A 6/1996 Cullen
5,531,334 A 7/1996 Forby
5,762,205 A * 6/1998 Davitz ..... 211/118 X
5,908,120 A * 6/1999 Yates et al. ..... 211/119
6,189,709 B1 * 2/2001 Cullen ..... 211/118

* cited by examiner

*Primary Examiner*—Robert W. Gibson, Jr.
(74) *Attorney, Agent, or Firm*—Fitch, Even, Tabin & Flannery

(57) ABSTRACT

A rack for hanging workpieces in industrial coating systems having a horizontal bar or beam with a first flange, a second flange, and a web joining those flanges, wherein the first flange has a hook receiving aperture and the second flange has a hook receiving slot. The aperture and the slot are aligned to receive a hook from which a workpiece may be hung. The hook is bent to form a spring having a terminal leg and a depending leg. The terminal leg extends into the aperture in the first flange and the depending leg extends through the slot in the second flange, behind a detent. The web is formed so as to providee a fulcrum against which the spring bears, biasing the depending leg against release from behind the detent.

4 Claims, 3 Drawing Sheets

RACK AND HOOKS FOR HANGING WORKPIECES IN INDUSTRIAL COATING SYSTEMS

RELATED APPLICATIONS

This is a continuation-in-part of U.S. patent application Ser. No. 09/455,150, filed Dec. 6, 1999, now U.S. Pat. No. 6,189,709, entitled "Rack and Hooks for Hanging Workpieces in Industrial Coating Systems". The description and drawings of that application are hereby incorporated as if fully set forth herein.

FIELD OF THE INVENTION

The present invention relates to racks for supporting workpieces in industrial coating operations and, more particularly, to such racks having removable hooks for hanging such workpieces. It finds particular application to industrial electrostatic coating systems.

BACKGROUND OF THE INVENTION

Industrial coating systems employ a conveyor from which workpieces are hung on hooks from an overhead conveyor and are conveyed through several stations, usually including stations for performing the steps of cleaning, rinsing, drying, and coating the workpieces, and thereafter baking the coating. In many industrial coating operations, the workpieces travel through an electrostatic coating booth wherein the electrically grounded workpieces are sprayed or coated with electrically charged coating particulates, either liquid or powder. After coating and baking, the coated workpieces are removed from the hooks, and the hooks and supporting racks are reused in another coating cycle. Because of the recycling of the hooks and racks, they become coated and encrusted with multiple layers of the coating material.

It is important in those instances where electrostatic coating is employed that the support rack be electrically conductive so that workpieces can be maintained in a grounded state. The workpieces are electrically connected to ground through a conductive support rack so that electrically charged particulates are attracted to the workpieces by the electrostatic field. Thus, it is desirable to provide a support rack wherein the electrical contact between individual hooks depending from the rack are maintained in low-resistance electrical contact with the rack so that the workpieces suspended from the hooks will be satisfactorily grounded.

Each coating cycle applies a coating layer to the exposed, workpiece-engaging portion of the support hook, which coating covers the entire surface of the hook except for the small area where the hook is in contact with the workpiece. Unless identical workpieces are coated in subsequent cycles, so that the workpiece is in electrical contact with the hook at an identical position, it becomes necessary to clean the support hook to assure the requisite electrical contact between the workpiece and the support hook. Accordingly, it is desirable that the support hooks be detachably engaged with the rack so that coated hooks can be periodically removed and replaced with new or cleaned hooks. Simple and rapid interchangeability of the support hooks is also desirable so that different sizes and shapes of support hooks can be interchanged as desired so that the rack may be used for coating a wide variety of workpieces. It is desirable to provide this interchangeability while still maintaining good electrical contact between each support hook and its respective rack during coating operations.

In this connection, it has been found desirable to form a support hook in the shape of a spring to bias a clean surface of the hook against a clean surface of its support rack. An early example of such a cooperative hook and rack construction may be found in U.S. Pat. No. 1,533,805, relating to a rack for electroplating workpieces. A more recent example of such a cooperative hook and rack construction may be found in U.S. Pat. No. 5,531,334, for electrostatically coating workpieces. A substantially improved system is disclosed in my copending application Ser. No. 455,150.

Prior art hook and rack constructions have been found to have certain shortcomings in industrial coating operations, and it is the principal object of the present invention to provide a hook and rack construction having substantially improved performance.

SUMMARY OF THE INVENTION

In accordance with the present invention, there is provided an inexpensive support rack and cooperating hook for supporting workpieces during transport through the various stations of an industrial coating operation. The rack comprises a horizontal bar or beam having a first flange, a second flange, and a web joining the flanges. The first flange has a hook-receiving aperture formed in it, and the second flange has a hook-receiving slot formed in it extending inwardly from an edge of the flange web and thence outwardly toward the edge to thereby provide a detent. The opening and the slot are aligned to receive a hook from which a workpiece may be hung. The hook is bent to form a spring having a terminal leg and a depending body leg. The terminal leg extends into the aperture in the first flange, and the depending leg extends through the slot formed in said second flange behind the detent. The web is formed so as to provide a fulcrum against which said spring bears. The force of the spring against the fulcrum biases the dependent leg behind the detent and against the blind end of the slot.

The bar and hook in combination provide means by which the hook may quickly be installed in the bar. The spring is biased against the side of the opening in the first flange and against the blind end of the slot in the second flange thereby enhancing the conductivity of the junction between the bar and the hook. The hook is nevertheless easily removed from the bar for substituting a new and uncoated hook or installing the same hook after the hook has been cleaned.

An important feature of the present invention is the provision of a horizontal bar or beam of enhanced stiffness, which resists bending along either the x-axis or y-axis of its cross-section. Prior art horizontal bars, such as those in the patents cited above, although providing acceptable stiffness along the y-axis, provide inferior stiffness against bending along the x-axis.

BRIEF DESCRIPTION OF THE DRAWING

In the drawing, where like elements are referred to by the same reference numeral followed by a lower case letter.

DETAILED DESCRIPTION OF THE PREFERRED EMBODIMENTS

Figures 1, 2A, 2B:
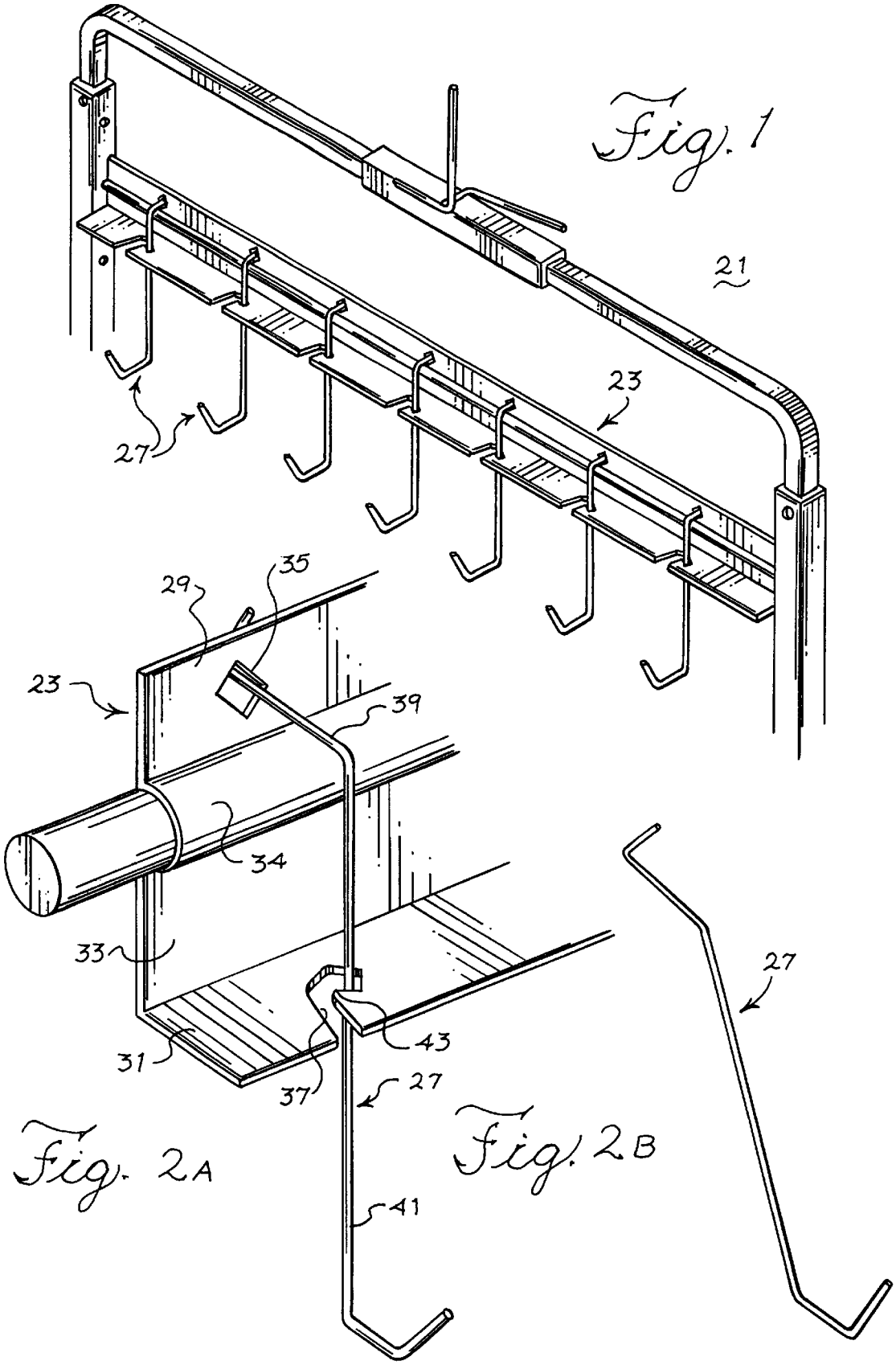
FIG. 1 is a fragmentary perspective view of a rack comprising a horizontal bar and support hooks embodying various features of the present invention.
FIG. 2A is an enlarged fragmentary perspective view of the bar and hook shown in FIG. 1.
FIG. 2B is a perspective view of the hook shown in FIGS. 1 and 2A.

Shown in FIG. 1 is a rack embodying various features of the present invention, referred to generally by the reference numeral 21. The rack 21 is designed to be supported from a chain conveyor in the manner shown in my U.S. Pat. Nos. 5,147,050 and 5,524,774, the disclosures of which are hereby incorporated by reference. The rack 21 includes a generally horizontal bar or beam 23 suitably attached to vertical members of the rack 21. Releasably secured to the bar 23 are a plurality of hooks 27 from which workpieces may be hung as the conveyor conducts the rack through various stations of the coating operation.

As shown more particularly in FIG. 2A, the bar 23 has three beam elements, namely, a first flange 29, a second flange 31, and a web 33 joining the flanges. The first flange 29 has an aperture 35 formed therein, and the second flange 31 has a slot 37 formed therein. The hook 27 is bent to provide a terminal leg 39 and a depending leg 41.

The slot 37 extends inwardly from the edge of the second flange 31, and thence outwardly toward the same edge to provide a detent 43.

The hook 27 is shown in FIG. 2B in its unrestrained position, before it is inserted into the hook-receiving aperture 35 and the hook-receiving slot 37. To detachably secure the hook 27 in the bar 23, the terminal leg 39 of the hook is first inserted into the aperture 35, and the depending leg 41 is then forced into the slot 37 until it clears the detent 43, and is retained behind the detent.

As the hook is inserted into the aperture 35 and behind the detent 43, it bears against a longitudinal, generally semicircular rib 34 formed in the web 33, which provides a fulcrum to bias the hook 27 against the edge of the aperture 35 in the first flange and against the blind end of the slot 37 in the second flange 31.

It will be seen that the aperture 35 is diamond shaped with one vee of the diamond pointing toward the edge of the first flange 29. The aperture is preferably formed by punching through the first flange with a diamond-shaped punch leaving relatively sharp edges around its periphery. These sharp edges enhance the conductivity of the junction between the terminal leg 39 of the hook and the edge of the aperture 35.

Similarly, the blind end of the slot 37, behind the detent 43, is also formed in a generally diamond-shape with one vee of the diamond pointing toward the edge of the second flange, so that the depending leg 41 of the hook is also in enhanced conductive relationship with the second flange 31.

It will be understood that when the depending leg 41 of the hook 27 is urged into position behind the detent 43, there is a spring bias urging that leg against the vee at the blind end of the slot 37, and also urging the terminal leg 39 against the vee of the aperture 35. This bias readily may be overcome by manual pressure, releasing the depending leg 41 from behind the detent and allowing the hook to be removed.

An advantage of the vee-shape of the bearing surfaces of the aperture 35 and the slot 37 is that it permits the use of hooks made of various gauges of wire to be received securely therein. The taper of the vee accommodates hooks formed of wire of substantially smaller diameter than the depth of the aperture 35 or the slot 37, while maintaining the desired enhanced conductive relationship between the hook and the bar.

The bar or beam 23 advantageously is made from flat steel stock, which is punched to form the apertures 35 and slots 37 while the stock is in its flat state. The punched flat stock thereafter is bent or folded to provide the first and second flanges 29 and 31, the web 33, and the rib 34.

Figure 3A:
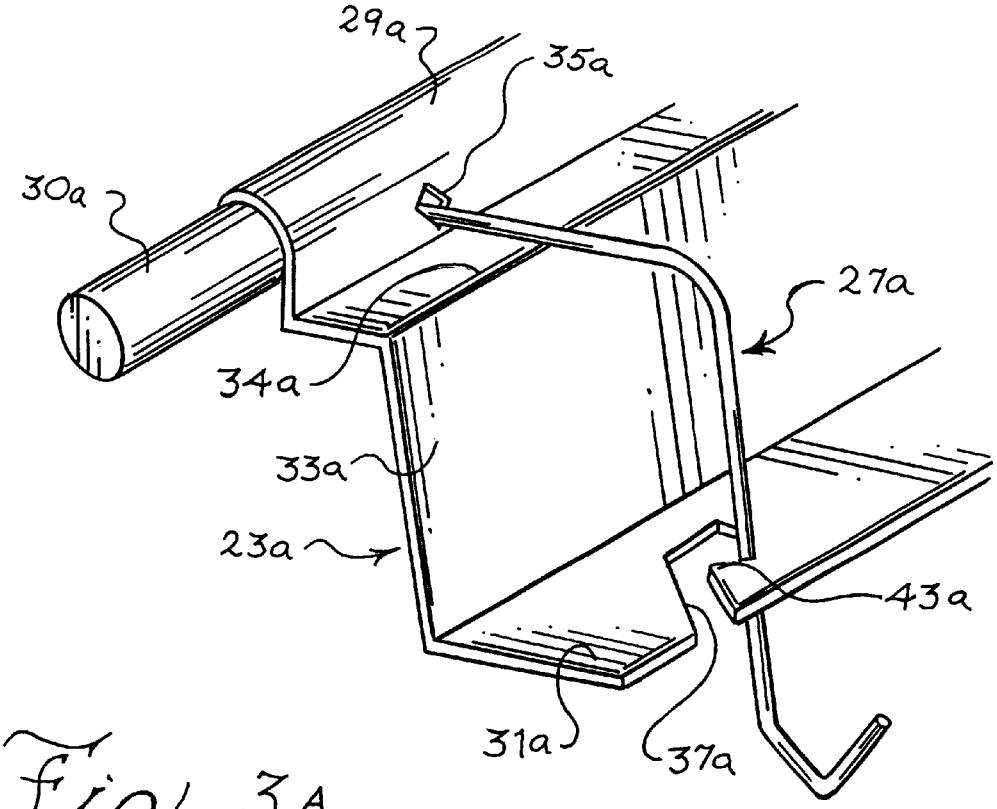
FIG. 3A is a fragmentary perspective view of an alternative embodiment of the bar and hook of the present invention.
Figure 3B:
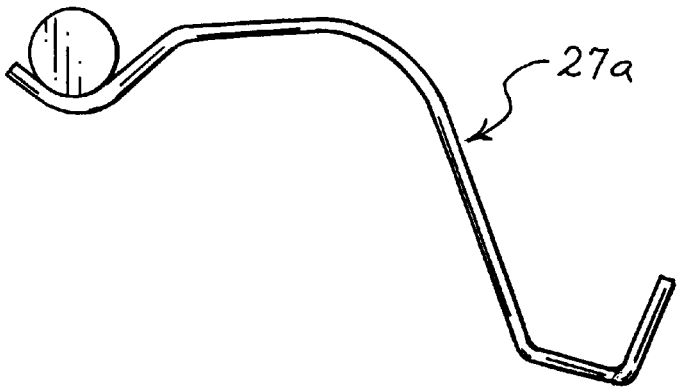
FIG. 3B is an end-view of the hook and support rod of FIG. 3A.

FIG. 3A shows an alternative embodiment of the bar and hook of FIGS. 1, 2A and 2B, in which the first flange 29*a* has a semicircular cross section conforming to the periphery of a support rod 30*a*. The web 33*a* is formed so as to provide a vee-shaped fulcrum 34*a*, which biases the legs of the hook against the aperture 35*a* and the vee of the slot 37*a*, as in the embodiment of FIGS. 1, 2A and 2B. FIG. 3B shows the hook 27*a* in its unrestrained configuration, as in the embodiment illustrated in FIG. 2B.

Figure 4:
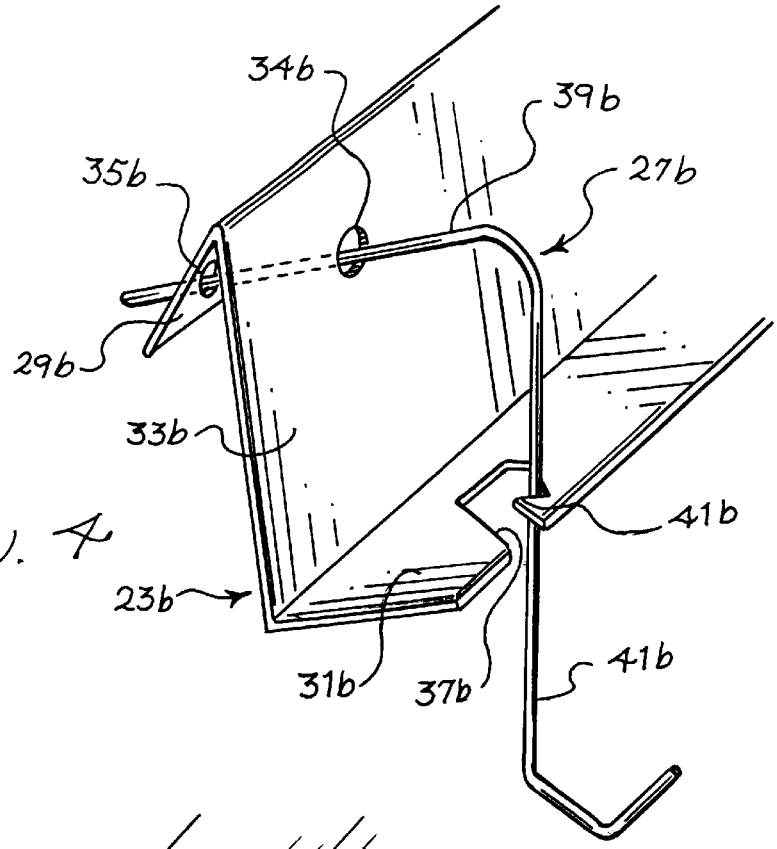
FIG. 4 is a fragmentary perspective view of another alternative embodiment of the bar and hook of the present invention.

FIG. 4 shows another alternative embodiment in which the hook 27*b* extends through a hole 34*b* in the web 33*b*, the rim of the hole providing a fulcrum biasing the legs of the hook against the aperture 35*b* and against the vee of the slot 37*b*.

Figure 5:
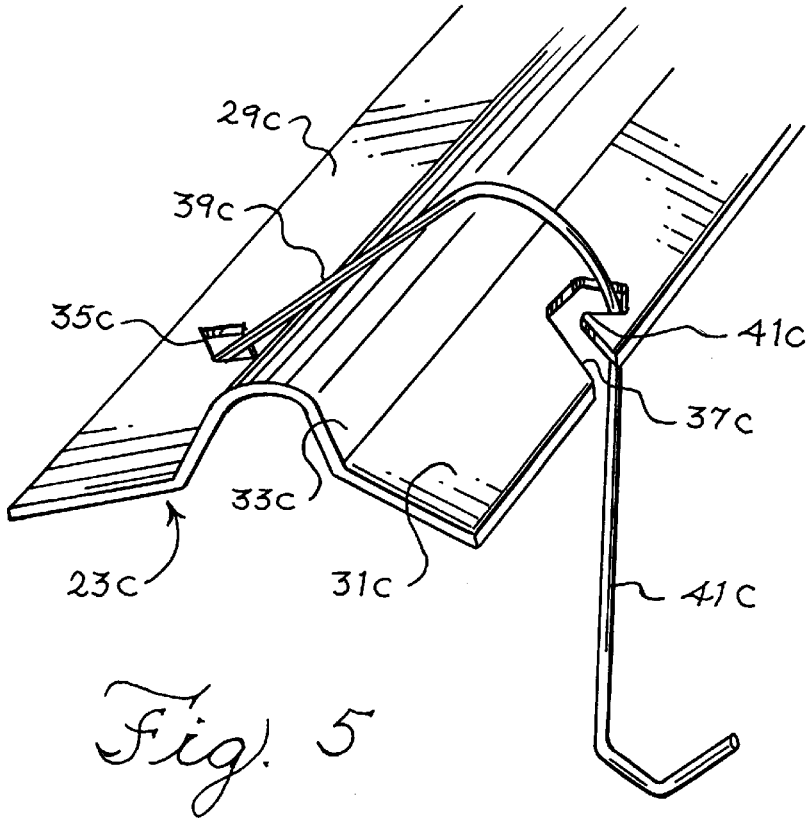
FIG. 5 is a fragmentary perspective view of yet another alternative embodiment of the bar and hook of the present invention.

FIG. 5 shows yet another embodiment of the bar and hook of the present invention, wherein the first flange 29*c* and the flange 31*c* are joined by a generally semicircular web 33*c*. The web 33*c* conforms to a rod (not shown) for supporting the bar 23*c*. The flange 33*c* provides a fulcrum biasing the terminal leg 39*c* against the vee-shaped aperture 35*c* and against the vee of the slot 37*c*.

While the present invention has been described with reference to a preferred embodiment and alternative embodiments, it will be understood by those skilled in the art that changes may be made and equivalents may be substituted for elements thereof without departing from the scope of the invention. In addition, many other modifications may be made to adapt a particular workpiece or material to the teachings of the invention without departing from the essential scope of the invention. It is therefore intended that the invention not be limited to the particular embodiments disclosed as the best mode for carrying out the invention, but that it should be construed to include all embodiments falling within the scope of the following claims.

What is claimed is:

1. A rack adapted for hanging workpieces in industrial coating operations comprising:

a horizontal beam having a first flange, a second flange, and a web joining said flanges, said first flange having a hook-receiving aperture formed therein, said second flange having a hook-receiving slot formed therein extending inwardly from an edge of said flange and thence outwardly to thereby define a detent, said aperture and said slot being aligned to receive a hook from which a workpiece may be hung, said hook being bent to form a spring having a terminal leg and a depending leg, said terminal leg extending into the aperture formed in said first flange and said depending leg extending through said slot formed in said second flange behind said detent, said web being formed so as to provide a fulcrum against which said spring bears, and the force of said spring against said fulcrum biasing said dependent leg against the blind end of the slot.

2. The rack of claim 1 wherein said fulcrum comprises a longitudinal rib formed in said web.

3. The rack of claim 1 wherein said web is bent along a longitudinal axis to provide said fulcrum.

4. The rack of claim 1 wherein said web has a hole formed therein aligned with said aperture and said slot adapted to receive the terminal leg of said spring therethrough, the periphery of said hole providing a fulcrum against which said spring bears.

* * * * *